US005452877A

United States Patent [19]

Riffle et al.

[11] Patent Number: 5,452,877

[45] Date of Patent: Sep. 26, 1995

[54] BEACH UMBRELLA ANCHOR BAG

[76] Inventors: Mary A. Riffle; Gilbert L. Riffle, both of 14240 Spriggs Rd., Woodbridge, Va. 22193; Karen R. Sampson, 13777 Coronado Ct., Manassas, Va. 22111; Penny R. McCeney, 14240 Spriggs Rd., Woodbridge, Va. 22193

[21] Appl. No.: 309,401

[22] Filed: Sep. 20, 1994

[51] Int. Cl.[6] ..... A45B 1/00

[52] U.S. Cl. ..... 248/511; 135/16; 135/902; 248/519; 248/910

[58] Field of Search ..... 248/511, 519, 248/530, 533, 910, 205.2; 135/16, 19, 908, 902, 27; 383/61, 67, 86

[56] References Cited

U.S. PATENT DOCUMENTS

| | | | |
|---|---|---|---|
| 2,883,247 | 4/1959 | Thompson | 135/16 X |
| 3,843,079 | 10/1974 | Reisling . | |
| 4,296,693 | 10/1981 | Archer | 248/910 X |
| 4,630,312 | 12/1986 | Milstein | 383/86 |
| 4,753,411 | 6/1988 | Lechner et al. | 248/910 X |
| 4,924,893 | 5/1990 | Furey . | |
| 5,050,830 | 9/1991 | Hall | 248/205.2 |
| 5,088,681 | 2/1992 | Procaccianti et al. . | |
| 5,098,057 | 3/1992 | Gran et al. . | |
| 5,143,108 | 9/1992 | Kenney . | |
| 5,273,062 | 12/1993 | Mozdzanowski | 135/16 |
| 5,288,150 | 2/1994 | Bearman | 383/67 X |

FOREIGN PATENT DOCUMENTS

| | | | |
|---|---|---|---|
| 994741 | 8/1976 | Canada | 248/910 |

*Primary Examiner*—Ramon O. Ramirez
*Assistant Examiner*—Derek J. Berger
*Attorney, Agent, or Firm*—Richard C. Litman

[57] ABSTRACT

A beach umbrella anchor bag is filled with a loose weighted material (i.e., sand or the like) and secured about the shaft of a beach umbrella to secure the umbrella in place against movement due to wind or other causes. The bag includes a relatively small bottom opening, allowing the shaft to be passed therethrough to penetrate the underlying surface for greater security. The bottom opening may be closed with a flap secured thereover, so the bag may be used for the carriage of other articles when not anchoring an umbrella or the like. The upper portion of the bag includes umbrella shaft attachment panels therein, which secure to the umbrella shaft to prevent relative movement therebetween, and the top opening of the bag includes a draw string to secure the mouth of the bag around the shaft to prevent spillage of material from the bag. The attachment panels may comprise hook and loop fastening material such as Velcro (tm), and cooperating flaps are provided within the bag to seal the inner panels against the intrusion of foreign matter when they are not secured to the umbrella shaft, and to preclude their attachment to articles carried in the bag. The bag may be formed of any suitable sheet of flexible material, such as Nylon (tm) taffeta, or other suitable durable material.

14 Claims, 4 Drawing Sheets

BEACH UMBRELLA ANCHOR BAG

FIELD OF THE INVENTION

The present invention relates generally to a weighted container serving to preclude movement of a lightweight article attached thereto, and more specifically to a bag which is adapted to be filled with loose sand or the like and which provides for the insertion of the shaft of an umbrella or the like therethrough. The container may also include a closable bottom opening for the umbrella shaft, and means for positively securing the mouth of the bag about the umbrella shaft for greater security.

BACKGROUND OF THE INVENTION

Persons who visit the beach or other generally sunny areas with little shade, often take a relatively large umbrella, parasol or the like along to provide supplemental shade. This has become increasingly important to many persons, as there is increasing concern regarding the potential damage that excessive sun can do to the skin.

However, beaches and other relatively open areas with few obstructions, are also open to the prevailing winds at any given time. The relatively large umbrellas and the like typically used on the beach, can be difficult to anchor to preclude their shifting or possible blowing away in the wind, even though many such umbrellas include a spiked lower end on the shaft to be driven into the sand or soil. Such anchoring may offer only a partial solution at best, depending upon the characteristics of the underlying surface, and when such an umbrella does blow away, the pointed shaft tip can be very hazardous to those downwind.

The need arises for a means of positively anchoring an umbrella, parasol or the like to preclude its shifting or movement due to any winds which may act upon the umbrella. The anchoring device should be extremely portable, foldable and lightweight when not in use, and provide for the use of native materials (sand or the like) placed therein to provide a relatively heavy temporary weight. The device should also include means for positively securing the mouth of the bag about the umbrella shaft, to provide further security against the umbrella rolling by holding the shaft against axial twisting. The anchor device should also include a bottom opening, providing for the insertion of the umbrella shaft completely therethrough to be driven into the underlying surface for even greater security. The bottom opening may include an optional closure means, if desired, so the anchor container or bag may be used for the carriage of other articles when not in use as an anchor.

DESCRIPTION OF THE PRIOR ART

U.S. Pat. No. 3,843,079 issued to David C. Reisling on Oct. 22, 1974 discloses a Flag Standard comprising a solid, relatively heavy base including a cylindrical passage extending from the top inwardly to the lower portion thereof. The passage provides for the insertion of a flagstaff therein, but does not penetrate out the bottom of the device. Thus, the flagstaff cannot provide additional anchoring means for the device, as in the present invention. Rather, the device must be made rigid, as it relies upon rigid spikes extending downward from the base thereof to secure the device to the underlying surface.

U.S. Pat. No. 4,924,893 issued to Charles Furey on May 15, 1990 discloses a Beach Umbrella Safety System comprising a bag which may be weighted with sand or the like, and a cable extending from the bag, up the shaft of the umbrella. The cable may be secured to the umbrella with slidably adjustable connectors. The bag has no means of securing its mouth about the shaft of the umbrella for further security, as in the present invention, nor is any means provided to pass the shaft completely through the bag and into the underlying surface. Rather, Furey avoids inserting the shaft through the bag for greater security, by completely separating the bag and the umbrella shaft, unlike the present invention.

U.S. Pat. No. 5,088,681 issued to Rudolph J. Procaccianti et al. on Feb. 18, 1992 discloses an Anchor Device for umbrella shafts and the like, comprising a helical flange which extends from a half cylinder shaped attachment portion. The device functions in the manner of a screw, enabling the umbrella shaft to be threaded into the underlying surface. No appreciable weight is added to the base of the shaft, as in the present invention, and the additional edges of the helical flange may create even more potential hazard if the umbrella to which it is attached, blows away.

U.S. Pat. No. 5,098,057 issued to Carl H. Gran et al. on Mar. 24, 1992 discloses a Shaft Anchoring Apparatus comprising a helical rod having a handle formed in the upper end thereof, in the manner of well known tiedowns and the like. The device includes a collar which is removably attachable to the upper portion of the rod, which in turn provides for the clamping of an umbrella shaft or the like therein. Again, no appreciable weight is added, and the potential hazard of a loose umbrella is evident.

Finally, U.S. Pat. No. 5,143,108 issued to Robert J. Kenney on Sep. 1, 1992 discloses a Beach Umbrella including a stand constructed around the shaft thereof, with the stand comprising separate plural levels containing drawers, cabinets and the like for the carriage of food and drink, audio systems, etc. The stand is rigid, in order to provide additional legs for the penetration of the underlying surface, rather than being a flaccid bag type container as in the present invention. The umbrella shaft supported therein is held vertically, with no means provided to tilt the umbrella to different angles for optimum shade. The device provides a flat upper surface for the support of various articles thereon, unlike the present anchor. At least the bottom portion is permanently affixed to the umbrella shaft, thus requiring the shaft to penetrate the underlying surface to a depth sufficient to allow the lower legs of the bottom portion to engage the surface also; this may prove difficult to say the least, depending upon the type of soil or surface in the area.

None of the above noted patents, taken either singly or in combination, are seen to disclose the specific arrangement of concepts disclosed by the present invention.

SUMMARY OF THE INVENTION

By the present invention, an improved beach umbrella anchor bag is disclosed.

Accordingly, one of the objects of the present invention is to provide an improved beach umbrella anchor bag which is constructed of a thin, flexible sheet of material for each of folding and storage when not in use, and which may be temporarily filled with native materials (e.g., sand or the like) to provide weight as desired.

Another of the objects of the present invention is to provide an improved beach umbrella anchor bag which may include a relatively small bottom opening therein, in addition to the top opening, providing for the insertion of an umbrella shaft or pole or the like therethrough, in order that the lower end of the shaft may be inserted into the underlying surface.

Yet another of the objects of the present invention is to provide an improved beach umbrella anchor bag which bottom opening may be sealed closed, if desired.

Still another of the objects of the present invention is to provide an improved beach umbrella anchor bag which includes mean for securing the upper portion of the bag to the umbrella shaft, and means for modifying the shaft to cooperate with the upper bag attachment means, to preclude the axial shifting of the shaft relative to the bag.

A further object of the present invention is to provide an improved beach umbrella anchor bag which includes means to preclude the capture of sand or the like within the umbrella shaft attachment means.

A final object of the present invention is to provide an improved beach umbrella anchor bag for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
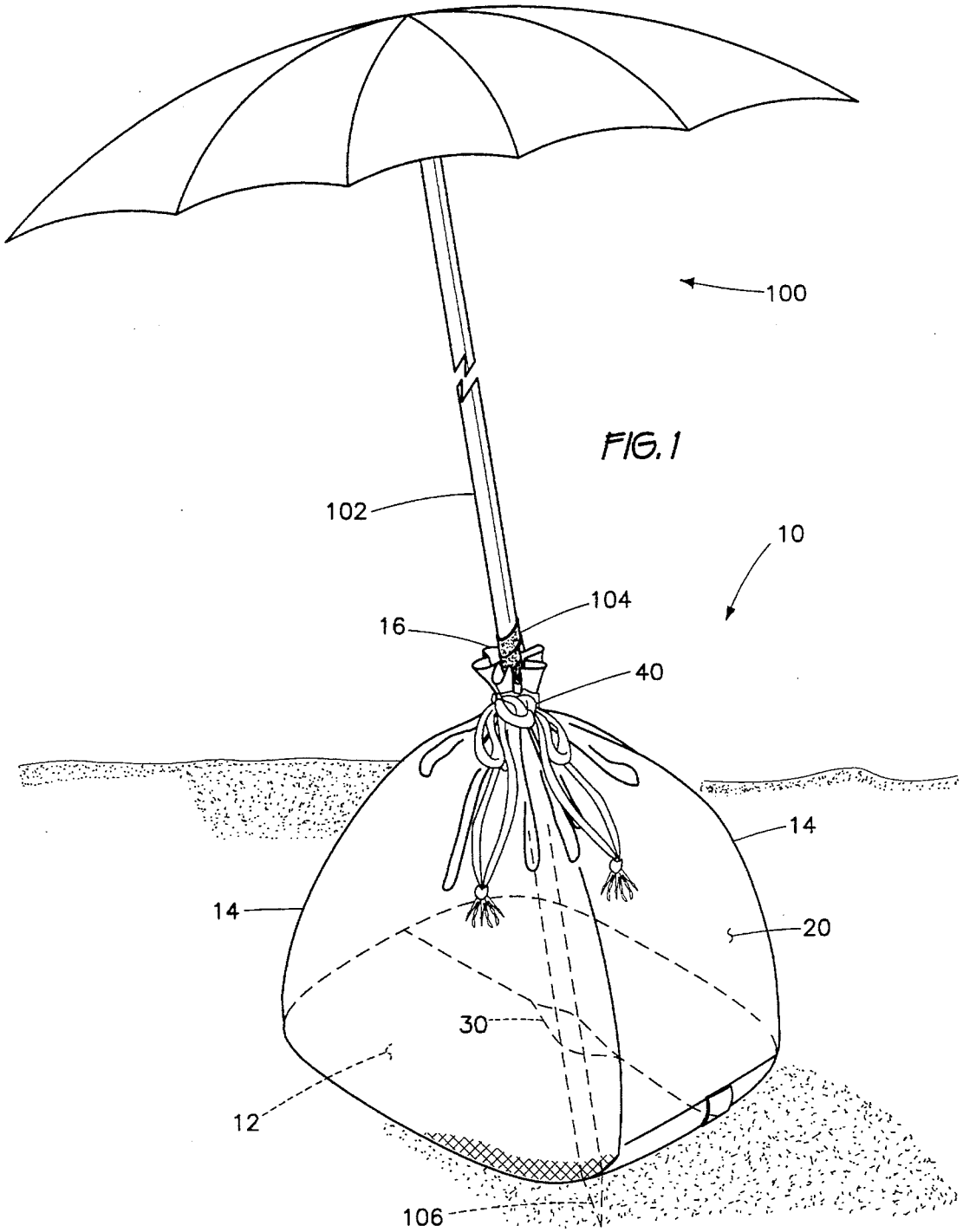
FIG. 1 is an environmental perspective view of the beach umbrella anchor bag of the present invention in use, showing its attachment around the shaft of an umbrella.

Referring now particularly to FIG. 1 of the drawings, the present invention will be seen to relate to a beach umbrella anchor bag 10, which serves to secure a beach umbrella 100 or the like to preclude shifting or movement of the umbrella 100 due to wind or other forces. The bag 10 may be formed of any suitable flaccid or flexible sheet material (e.g., plastic sheet, etc.), but is preferably formed of a durable synthetic fabric having a weave sufficiently dense or tight to preclude significant passage of typical sand grains or particles therethrough. Nylon (tm) taffeta fabric material has been found to work well, although other materials may be substituted as desired.

The bag or container 10 includes a bottom panel 12, side enclosure 14, and an open top 16 which is closable about the shaft 102 of the umbrella 100. The material comprising the bottom panel 12 and side enclosure 14 includes an inner surface 18 (FIG. 2) and an outer surface 20.

Figure 2:
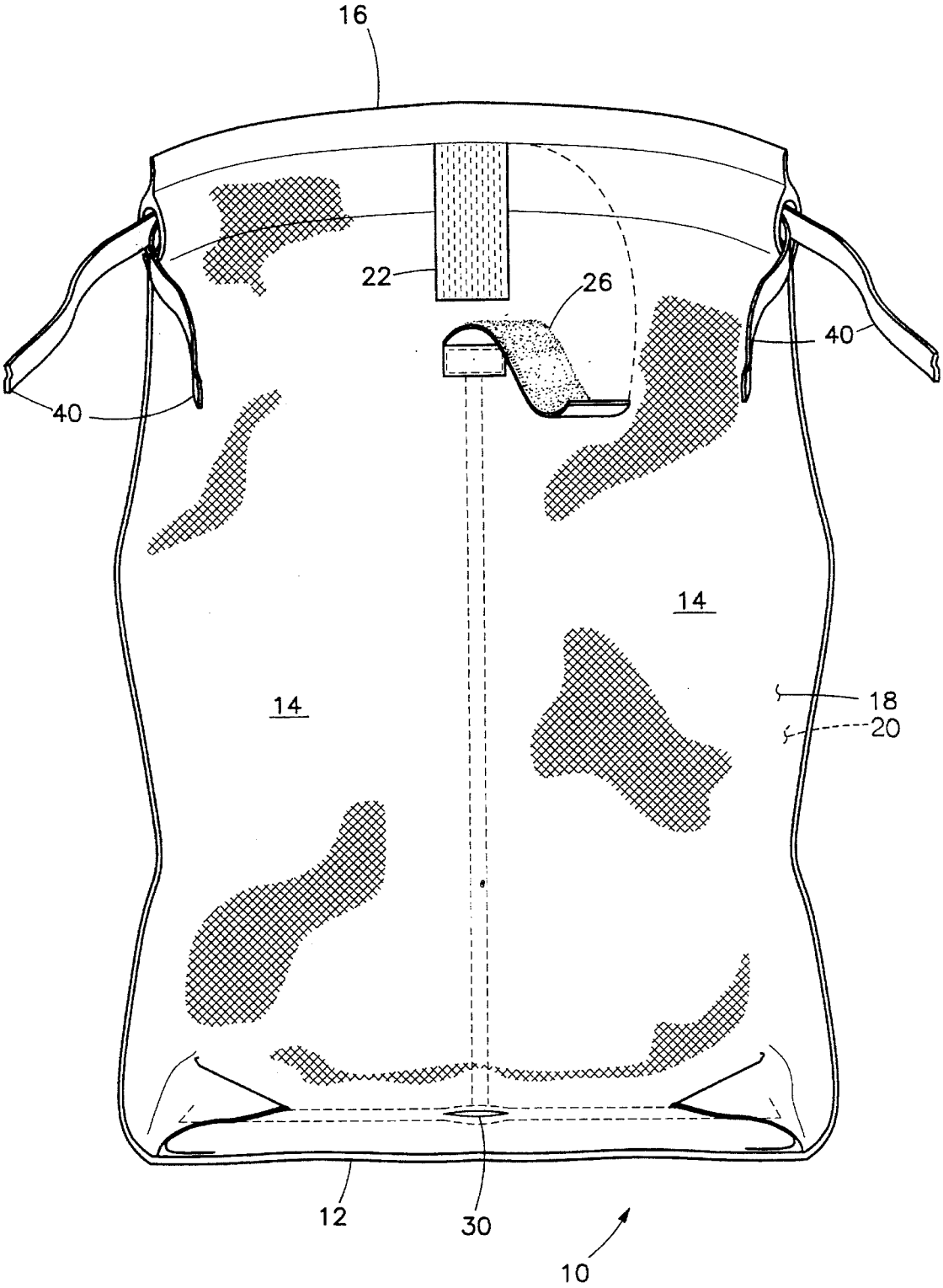
FIG. 2 is an interior perspective view in section of the present bag, showing various details.
Figure 3:
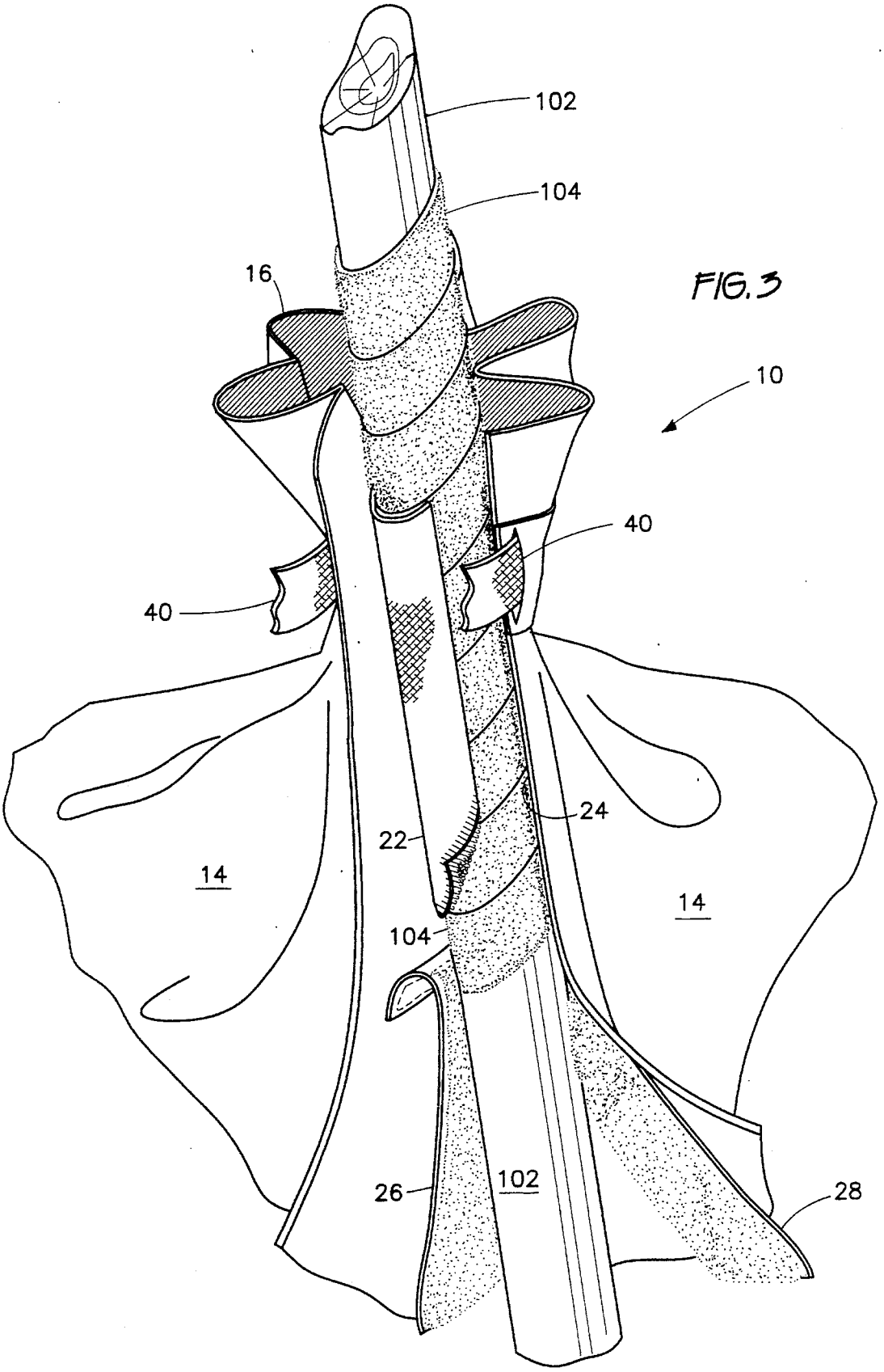
FIG. 3 is a side view in partial section of the upper portion of the present bag secured to an umbrella shaft and showing various details of the bag and of the modified umbrella shaft.

FIG. 2 provides a disclosure of the detail of the interior of the bag 10. Two elongate oppositely spaced apart panels 22 and 24 (one edge of which may be seen in FIG. 3) of hook and loop fastening material (e.g., Velcro, tm) extend along the inner surface 18 of the bag 10 downwardly from the edge of the top opening 16. These two panels provide for the attachment of the upper portion of the bag 10 to the shaft or pole 102 of the umbrella 100, by means of a cooperating mating portion of hook and loop material 104 secured to the umbrella shaft 102. The mating fastening material 104 may comprise an adhesive backed elongate strip, spirally wound about the shaft 102 as shown, or other means as desired.

As the present umbrella anchor bag is to be used on the beach and in areas of sand and the like, provision is made to preclude the intrusion of sand and other foreign matter from the hook and loop material to the greatest degree possible under the circumstances of use. It has been found that sand will brush or shake from the loop portion of hook and loop fastening material more easily than from the hook portion of such material. Accordingly, the material 104 on the umbrella shaft 102 is preferably loop material, as shown, as it will be exposed to sand and the like during insertion in the bag 10 and while the bag 10 and umbrella 100 are assembled. The cooperating panels 22 and 24 of material which are secured to the inner surface 18 of the bag 10, are thus formed of hook type sheets of material, in order to engage the loop material 104 of the shaft 102. While the opposite arrangement may be used also, it has been found that the above specific positioning of the two different types of material comprising hook and loop fastening material, is optimum.

The above arrangement will be seen to allow sand or the like to intrude upon the hook type material of the two opposite umbrella shaft attachment panels 22 and 24, if other means are not provided to preclude such intrusion. Accordingly, two oppositely disposed and spaced apart sealing flaps 26 and 28 are provided, with one of the flaps 26 and 28 secured at one end immediately below each of the attachment panels 22 and 24. The opposite ends of the sealing flaps is left loose to depend from the attachment point when they are not sealed to the attachment panels 22 and 24. When the umbrella shaft 102 is removed from the bag 10, the two sealing flaps 26 and 28 may be applied to the two umbrella shaft attachment panels 22 and 24, to prevent the entry of sand or other foreign matter into the hook material of the attachment panels 22 and 24. In this configuration, the sealing flaps 26 and 28 are formed from loop type materials, to cooperate with the hook type material of the umbrella shaft attachment panels 22 and 24; the reverse configuration may be used, if desired, but the above arrangement has been found preferable. The flaps 26 and 28 provide an additional advantage, when the bag 10 is used to carry other articles therein, in that the flaps 26 and 28 prevent the attachment of other articles (e.g., beach towels, etc.) on the hooks of the shaft attachment panels 22 and 24, when the flaps 26 and 28 are applied over the panels 22 and 24.

Figure 4:
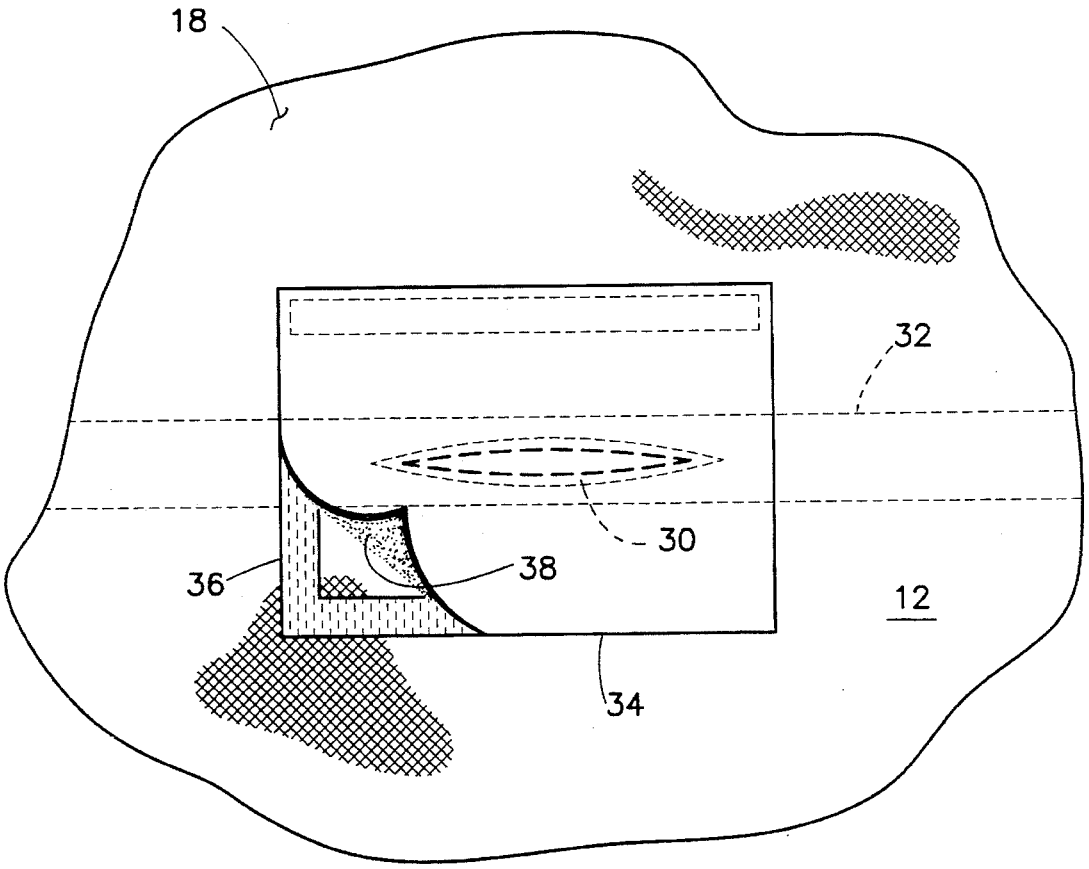
FIG. 4 is a bottom view of the bag, showing the lower shaft opening and an optional cover therefor.

FIG. 4 provides a view of the interior of the bottom panel 12 of the bag 10. A relatively small opening 30 is provided therein, which opening 30 is sized to provide a relatively close fit around the shaft 102 of the umbrella 100. The opening 30 may be made along the central bottom seam 32, or otherwise formed. If the opening 30 comprises an elongate slit, as shown, a relatively tight fit around the shaft 102 is still provided, due to the flexible nature of the material from which the bag 10 is formed.

Additional versatility for the bag 10 may be provided by means of an optional bottom opening closure flap 34, if desired. The bottom opening 30 may be surrounded by portions of hook and loop material 36 around the periphery thereof, with the closure flap 34 formed of or including mating hook and loop fastening material 38 thereon; one edge may be stitched or otherwise permanently secured adjacent a mating edge of the opening 30. Preferably, the same consideration relating to sand or foreign matter intrusion into the hook and loop material is provided for the bottom closure means, by forming the peripheral hook and loop material portions 36 of hook material, since they are covered by the closure flap when the opening is closed, and further have a smaller surface area to catch such sand particles or the like. The mating closure flap 34 may be formed of or include complementary loop material 38 thereon. As in the umbrella shaft attachment panels 22 and 24 and their mating sealing flaps 26 and 28, the opposite arrangement may be used, or other closure and/or sealing means may be provided as desired.

The above described beach umbrella anchor bag 10, with a suitably configured beach umbrella 100, will be seen to provide a secure means of anchoring such an umbrella 100 against wind and other forces during deployment at the beach or other area of use. The bag 10 may be used to carry various articles (e.g., towels, beach blanket, tanning lotion or sun screen, food and refreshments, etc.) to the selected site at the beach, whereupon those articles may be removed from the bag 10 and the bottom opening closure flap 34 opened to provide for passage of the umbrella shaft 102 through the bottom opening 30. The lower end 106 of the umbrella shaft may then be inserted into the sand or surface to provide some security, and the bag 10 filled with sand or other loose weighted material as available, to provide additional mass for the umbrella 100. The sealing flaps 26 and 28 may then be removed from the respective two umbrella shaft attachment panels 22 and 24, and the panels 22 and 24 secured to the mating hook and loop material 104 on the umbrella shaft 102. Additional security for the assembly may be provided by means of the draw string closure 40, around the periphery of the top opening 16 of the bag 10, serving to prevent the escape of loose sand or the like during use.

The positive grip of the mating attachment panels 22 and 24, and the umbrella shaft material 104, insure that the umbrella shaft 102 cannot either rotate or shift axially relative to the bag 10, thus helping to prevent the umbrella 100 from rolling over or otherwise shifting or moving due to wind gusts or other forces. The flexible nature of the bag 10 material, provides for the umbrella shaft 102 to be positioned at any desired angle to provide optimum shading from the sun, rather than requiring the umbrella shaft 102 to be positioned vertially as in a rigid stand. The multiple securing means (umbrella shaft penetration of the underlying surface; grip of attachment panels to the umbrella shaft; draw string closure; and weighted bag) all serve to prevent any undesired movement of the umbrella.

When the day is over, the retrieval of the above articles is a simple matter of loosening the draw string closure 40, unfastening the two panels 22 and 24 from the cooperating material 104 on the umbrella shaft 102, sealing the two panels 22 and 24 with the respective sealing flaps 26 and 28, and withdrawing the lower end 106 of the umbrella shaft 102 from the underlying surface, through the lower opening 30, and upward out of the top opening 16 of the bag 10. The bag 10 may then be emptied of sand or other loose weighted material or foreign matter and shaken out, the bottom closure flap 34 (if provided) sealed over the smaller bottom opening 30, and the bag 10 used to carry the various articles, trash, etc. from the site. The use of durable materials for the construction of the bag 10 (preferably nylon taffeta, as described above) provide a bag 10 which will resist sun and moisture problems over a long period of use. The bag 10 may be provided in bright colors and patterns if desired, to provide a decorative effect on the beach or wherever it is used, and to assist the owners thereof in locating their specific beach site after swimming or leaving the site temporarily.

It is to be understood that the present invention is not limited to the sole embodiment described above, but encompasses any and all embodiments within the scope of the following claims.

We claim:

1. A beach umbrella anchor bag providing for the anchoring of a beach umbrella shaft thereto, comprising:

a bag formed of a thin, flexible sheet of material having an inner surface and an outer surface, said bag including a bottom panel, a side enclosure, and an open top providing for the insertion of an umbrella shaft therein and for the temporary placement of loose weighted material therein;

said inner surface of said bag including umbrella shaft attachment means secured adjacent to said open top, and said open top including top securing means providing for the closure of said open top about the umbrella shaft;

said umbrella shaft attachment means comprising two elongated, oppositely spaced apart first panels of hook-and-loop fastening material extending along said inner surface of said bag downwardly from said top opening;

sealing means for said first panels, comprising a flap of mating material of hook-and-loop fastening material secured to said inner surface immediately below each of said first panels and foldable thereover, whereby intrusion of foreign material into said first panels is precluded when each said flap of mating material is folded thereover;

said bottom panel including a small opening therein, adapted to provide a close fit about an umbrella shaft inserted therethrough, whereby;

an umbrella shaft is inserted through said bag by means of said open top and said small opening in said bottom panel and inserted into an underlying surface, loose weighted material is temporarily placed within said bag, said umbrella shaft attachment means is secured to the umbrella shaft, and said securing means is secured about the umbrella shaft to close said top opening and secure said anchor bag to the umbrella shaft and provide further security for an umbrella inserted into the underlying surface.

2. The beach umbrella anchor bag of claim 1 wherein:

said bag is formed of a synthetic fabric material.

3. The beach umbrella anchor bag of claim 2 wherein:

said synthetic fabric material is Nylon taffeta.

4. The beach umbrella anchor bag of claim 1 wherein:

said first panels comprise hook portions of hook and loop fastening material, and each said flap of mating material comprises loop portions of hook and loop fastening material.

5. The beach umbrella anchor bag of claim 1 wherein:

said top securing means comprises a draw string closure disposed about said top opening and providing for the closure thereof.

6. The beach umbrella anchor bag of claim 1 wherein:

said opening in said bottom panel includes closure means therefor, comprising a flap of material secured adjacent said bottom panel opening and foldable thereover, with said opening including peripheral first portions of hook and loop fastening material therearound and said closure flap including mating material thereon to secure said closure flap across said opening.

7. The beach umbrella anchor bag of claim 6 wherein:

said first portions of hook and loop fastening material comprise hook portions, and said mating material on said closure flap comprises loop portions of hook and loop fastening material.

8. In combination with a beach umbrella having a shaft, a beach umbrella anchor bag providing for the anchoring of said shaft thereto, comprising:

a bag formed of a thin, flexible sheet of material having an inner surface and an outer surface, said bag including a bottom panel, a side enclosure, and an open top providing for the insertion of said shaft therein and for the temporary placement of loose weighted material therein;

said inner surface of said bag including umbrella shaft attachment means secured adjacent to said open top, said shaft including cooperating bag attachment means thereon, and said open top including top securing means providing for the closure of said open top about said shaft;

said umbrella shaft attachment means comprising two elongated, oppositely spaced apart first panels of hook and loop fastening material, extending along said inner surface of said bag downwardly from said top opening, and said cooperating bag attachment means comprising a strip of cooperating fastening material secured around said shaft, whereby said first panels and said strip of cooperating fastening material are secured together to secure said bag to said shaft and preclude relative movement therebetween;

sealing means for said first panels, comprising a flap of mating material of hook and loop fastening material secured to said inner surface of said bag immediately below each of said hook panels and foldable thereover, whereby intrusion of foreign matter into said first panels is precluded when each said flap of mating material is folded thereover;

said bottom panel including a small opening therein, adapted to provide a close fit about said shaft inserted therethrough, whereby;

said shaft is inserted through said bag by means of said open top and said small opening in said bottom panel and inserted into an underlying surface, loose weighted material is temporarily placed within said bag, said umbrella shaft attachment means is secured to said cooperating bag attachment means on said shaft, and said securing means is secured about said shaft to close said top opening and secure said anchor bag to said shaft and provide further security for said umbrella inserted into the underlying surface.

9. The beach umbrella and anchor bag of claim 8 wherein:

said bag is formed of a synthetic fabric material.

10. The beach umbrella and anchor bag of claim 9 wherein:

said synthetic fabric material is Nylon taffeta.

11. The beach umbrella and anchor bag of claim 8 wherein:

said first panels comprise hook portions of hook and loop fastening material, and each said flap of mating material comprises loop portions of hook and loop fastening material.

12. The beach umbrella and anchor bag of claim 8 wherein:

said top securing means of said bag comprises a draw string closure disposed about said top opening and providing for the closure thereof about said umbrella shaft to seal said bag to said umbrella shaft and preclude the escape of material from said bag.

13. The beach umbrella and anchor bag of claim 8 wherein:

said opening in said bottom panel of said bag includes closure means therefor, comprising a flap of material secured adjacent said bottom panel opening and foldable thereover, with said opening including peripheral first portions of hook and loop fastening material therearound and said closure flap including mating material thereon to secure said closure flap across said opening.

14. The beach umbrella and anchor bag of claim 13 wherein:

said first portions of hook and loop fastening material comprise hook portions, and said mating material on said closure flap comprises loop portions of hook and loop fastening material.

* * * * *